US012599270B2

(12) United States Patent
Watson

(10) Patent No.: US 12,599,270 B2
(45) Date of Patent: Apr. 14, 2026

(54) PORTABLE PERSONAL HAND SANITIZER DISPENSER

(71) Applicant: Michael Watson, Hope (CA)

(72) Inventor: Michael Watson, Hope (CA)

( * ) Notice: Subject to any disclaimer, the term of this patent is extended or adjusted under 35 U.S.C. 154(b) by 284 days.

(21) Appl. No.: 18/159,809

(22) Filed: Jan. 26, 2023

(65) Prior Publication Data

US 2023/0165411 A1 Jun. 1, 2023

Related U.S. Application Data

(63) Continuation of application No. PCT/CA2021/051052, filed on Jul. 27, 2021.

(60) Provisional application No. 63/057,060, filed on Jul. 27, 2020.

(51) Int. Cl.

| | |
|---|---|
| ***A47K 5/12*** | (2006.01) |
| ***A45C 13/10*** | (2006.01) |
| ***A45F 5/02*** | (2006.01) |

(52) U.S. Cl.

CPC ..... *A47K 5/1201* (2013.01); *A45C 13/1069* (2013.01); *A45F 5/021* (2013.01); *A45C 2013/1015* (2013.01)

(58) Field of Classification Search

CPC ..... A47K 5/1201; A45C 13/1069; A45C 2013/1015; A45F 5/021; A45F 5/02; A45D 2034/005; A45D 34/00

See application file for complete search history.

(56) References Cited

U.S. PATENT DOCUMENTS

| | | | | |
|---|---|---|---|---|
| 5,927,548 | A | 7/1999 | Villaveces | |
| 6,125,513 | A | 10/2000 | Cheraso et al. | |
| 2003/0019536 | A1 | 1/2003 | Smith | |
| 2006/0078484 | A1 | 4/2006 | Greep | |
| 2007/0174152 | A1* | 7/2007 | Bjornberg | G01C 15/00 705/28 |
| 2010/0094581 | A1 | 4/2010 | Cagle | |
| 2013/0068791 | A1 | 3/2013 | Pelfrey et al. | |
| 2013/0299533 | A1 | 11/2013 | Gronewoller et al. | |
| 2013/0334248 | A1 | 12/2013 | Iseri et al. | |
| 2015/0227705 | A1 | 8/2015 | Zaima et al. | |

FOREIGN PATENT DOCUMENTS

| | | | |
|---|---|---|---|
| CN | 104853849 | A | 8/2015 |
| CN | 106163356 | A | 11/2016 |
| CN | 109906048 | A | 6/2019 |

* cited by examiner

*Primary Examiner* — Vishal Pancholi
(74) *Attorney, Agent, or Firm* — Nicholas Garner; Oyen Wiggs Green & Mutala LLP

(57) ABSTRACT

A dispensing apparatus is disclosed. The dispensing apparatus has application in providing a portable readily accessible supply of hand sanitizer. The dispensing apparatus includes an engagement interface. Upon operating the engagement interface, a fluid such as hand sanitizer is released from an outlet. The dispensing apparatus contains a replaceable cartridge that can be filled with a fluid. The replaceable cartridges have a seal that is pierced by a spur in the dispensing apparatus. The dispensing apparatus also has a clip that is operable to affix the dispensing apparatus to an item of clothing. The clip can be locked in an open position by a detent to stand the dispensing apparatus on a surface.

68 Claims, 8 Drawing Sheets

PORTABLE PERSONAL HAND SANITIZER DISPENSER

REFERENCE TO RELATED APPLICATIONS

This application claims the benefit of U.S. Patent Application Ser. No. 63/057,060, filed Jul. 27, 2020.

TECHNICAL FIELD

This invention relates to personal hygiene accessories, in particular apparatuses for sanitizing hands.

BACKGROUND

There is a general desire to maintain hand hygiene to avoid transmission of germs and diseases. This is particularly relevant for front-line workers such as healthcare workers, members of fire departments, and members of the police. Individuals working in these positions often require clean hands, but may not always have access to running water and soap to wash their hands. The demanding nature of front-line work is such that rapid response to emergency situations is often required, therefore convenient access to hand sanitizer is essential. For this reason, there remains a need for a method of sanitizing one's hands that is fast and effective, yet also convenient.

The foregoing examples of the related art and limitations related thereto are intended to be illustrative and not exclusive: United States Patent Application Publication No. 2013/068791 A1 to Pelfrey et al.; United States Patent Application Publication No. 2003/019536 A1 to Smith and United States Patent Application Publication No. 2013/299533 A1 to Gronewoller et al.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a wearable personal dispensing apparatus comprising: a housing; an attachment interface affixed to the housing and operable to affix the dispensing apparatus to an item of clothing; an outlet on the housing; a replaceable cartridge containing a fluid; an electrically-powered metering mechanism fluidly connected to the outlet; and an engagement interface on the housing, the engagement interface operable to control the metering mechanism to dispense a volume of the fluid from the outlet.

In some embodiments, the fluid is hand sanitizer.

The item of clothing could be a belt. The attachment interface could be a clip. In some embodiments, the clip is biased to a generally closed position by a bias mechanism. A detent may be provided to hold the clip in a generally open position against the force applied by the bias mechanism. In some embodiments, the dispensing apparatus can be stably supported in an upright position on a surface while the clip is being held in the generally open position by the detent.

In some embodiments, the attachment interface comprises one or more of: a hook and loop fastener; one or more magnets; and a MOLLE connector.

The engagement interface comprises a control operable by a person: button. In some embodiments, the control is recessed in the housing. In some embodiments, the engagement interface is centered from side to side on the housing.

The engagement interface is operable to control the metering mechanism to dispense the fluid. The metering mechanism may be configured to dispense a prescribed volume of fluid each time the engagement interface is operated.

The metering mechanism may be located below the cartridge. In some embodiments, the metering mechanism comprises a pump that is fluidly connected between the replaceable cartridge and the outlet. In some embodiments, the pump is electrically powered. A battery may supply electrical power to operate the dispensing apparatus. The battery may be rechargeable. In some embodiments, the battery is rechargeable via a USB recharging interface. In some embodiments, the battery is disposable. The battery could be, for example, an AA, AAA, D, or C type battery. Some embodiments include an indicator that indicates a level of charge remaining in the battery.

The replaceable cartridge could have a breakable seal that is punctured upon the cartridge being inserted into the dispensing apparatus. The seal could be puncturable by a spur that is fluidly connected to the outlet. In some embodiments, the tip of the spur is tapered. A gasket may surround the seal.

In some embodiments, the replaceable cartridge is disposable. In some embodiments, the replaceable cartridge is recyclable. Replaceable cartridges containing different types of fluid may be provided.

In some embodiments, the replaceable cartridge is accessible by way of a door formed in the housing. The door may be located on one side of the housing. The door may have a latch (e.g. a latch comprising a pair of magnets) to facilitate access to the replaceable cartridge.

The replaceable cartridge may span most (e.g. at least 80% or at least 85%) of the way side to side across the housing. The replaceable cartridge may be inserted sideways into the housing. A pull tab may be provided to assist with removal of the replaceable cartridge. The pull tab may contain instructions for operation of the dispensing apparatus.

In some embodiments, the replaceable cartridge is sized to hold 40 mL±20 mL of fluid.

Some embodiments include a fluid level indicator that is operated when the remaining amount of the fluid in the replaceable cartridge has been reduced below a prescribed level. The fluid level indicator may, for example, comprise a light and/or an audible indicator. For example, a sound emitted by a speaker could signify that the fluid in the replaceable cartridge has reached a prescribed level.

In some embodiments, the cartridge is comprised of a semi-rigid or rigid material.

In some embodiments, the height of the housing is 150 mm or less or 120 mm or less or 100 mm or less.

In some embodiments, the width of the housing is 100 mm or less or 70 mm or less.

In some embodiments, the depth of the housing is 40 mm or less or 30 mm or less or 25 mm or less.

In some embodiments, the dispensing apparatus weighs in the range of 4 ounces to 6 ounces.

In some embodiments, the housing comprises a grommet at the interface between the housing and the engagement interface, the housing and the attachment interface, the housing and the door, the housing and the outlet, and around the edges of the housing. In some embodiments, the housing is impact resistant. The housing may be configured to have rounded edges.

The housing may for example comprise plastic, metal, or leather. In some embodiments, the housing is dust resistant, preferably dust and moisture resistant. The housing may for example have an ingress protection rating of IP45 or IP67.

Another aspect of the invention provides a dispensing apparatus comprising: a housing, an outlet on the housing, an attachment interface on the housing, a fluid contained in a replaceable cartridge, an actuator fluidly connected to the outlet and the fluid, an engagement interface on the housing, and a means for dispensing the fluid by engaging with the engagement interface.

Another aspect of the invention provides a dispensing apparatus comprising: a housing; an outlet on the housing; a clip affixed to the housing, wherein the clip has a first end and a second end, wherein the clip has a hinge, wherein the hinge is sprung such that the second end of the clip is forced into contact with the housing, wherein a detent is affixed to the housing, wherein the detent is operable to hold the first end of the clip against the force of the hinge thereby holding the second end of the clip away from the housing; hand sanitizer contained in a cartridge that is replaceable, wherein the hand sanitizer is fluidly connected to the outlet on the housing, wherein the cartridge has a seal that can be punctured, wherein the dispensing apparatus has a spur that is configured to puncture the seal when the cartridge is inserted into the dispensing apparatus; a button on the housing operable to dispense a volume of the hand sanitizer upon engaging with the engagement interface, wherein an electric pump dispenses the volume of the hand sanitizer, and wherein the electric pump is powered by a rechargeable battery.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description, specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1A:
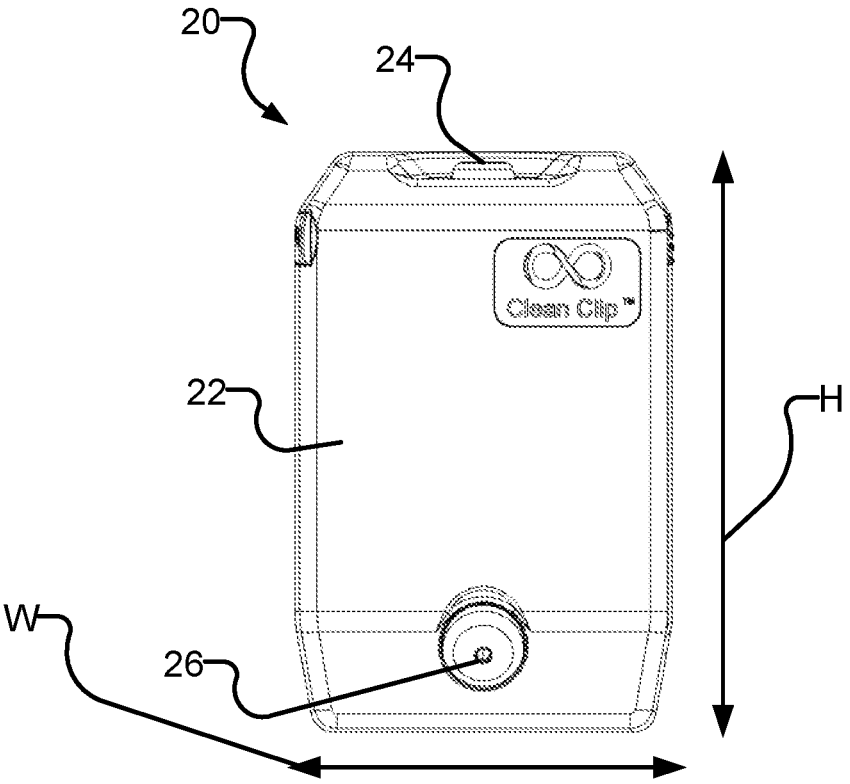
FIG. 1A is a front view of a dispensing apparatus according to an example embodiment of this invention.

FIG. 1A is a front view of a dispensing apparatus 20 according to an example embodiment. Dispensing apparatus 20 is intended for use as a portable personal dispensing apparatus that can be worn by an individual.

Dispensing apparatus 20 includes housing 22, engagement interface 24, and outlet 26. Dispensing apparatus 20 is operable to release a fluid (e.g. hand sanitizer). To release a fluid from dispensing apparatus 20, a user engages with engagement interface 24. This engagement triggers operation of an actuator 42 (see FIG. 5 and FIG. 6) to release a volume of fluid from outlet 26.

Engagement interface 24 may be hand-operated. For example, engagement interface 24 is depicted as a button in FIG. 1A. Upon depressing the button, an electrical circuit is closed that actuates an actuator 42 (see FIG. 5 and FIG. 6) thereby releasing a fluid from outlet 26. Engagement interface 24 is placed in a portion of housing 22 that is recessed to reduce the likelihood that engagement interface 24 will be accidentally engaged. In some embodiments, engagement interface 24 comprises a touchscreen interface, a proximity sensor, a switch, or a pressure sensor. In some embodiments, engagement interface 24 is centered on housing 22 to facilitate ambidextrous use of dispensing apparatus 20.

Housing 22 surrounds components internal to dispensing apparatus 20. Housing 22 may comprise a rigid material. For example, housing 22 may comprise metal (such as, but not limited to, aluminum or an aluminum alloy), or plastic (such as, but not limited to polyethylene or polycarbonate). The rigid materials provide impact resistance for dispensing apparatus 20. Housing 22 may also comprise a semi-rigid material, such as (but not limited to) leather or fabric. Housing 22 may have rounded edges so as to avoid catching on other objects (such as clothing, car seats, etc.). In some embodiments, housing 22 has dust resistance, and preferably has dust and moisture resistance. In some embodiments, housing 22 has an IP45 rating for ingress protection. In some embodiments, housing 22 has an IP67 rating for ingress protection, which provides complete protection from ingress of dust, and ingress protection against water when submersed for 30 minutes at a depth of 1 meter.

Apparatus 20 is preferably compact to allow it to be comfortably worn by an individual. In some embodiments, the height (represented by dimension H in FIG. 1A) of dispensing apparatus 20 is approximately 100 mm or less or 150 mm or less. In some embodiments the width (represented by dimension W in FIG. 1A) of dispensing apparatus 20 is 70 mm or less or 100 mm or less. In some embodiments the depth (represented by dimension D in FIG. 1C) of dispensing apparatus 20 is 25 mm or less or 40 mm or less.

Apparatus 20 is preferably thin. A ratio of depth to height (D:H) is preferably 1:4 or less. A ratio of depth to width to height (D:W) is preferably 1:3 or less.

As described in more detail below, fluid to be dispensed by dispensing apparatus 20 is provided in cartridges 32. This facilitates rapidly refilling of dispensing apparatus 20. The cartridges may be rigid or semi-rigid cartridges.

Figure 1B:
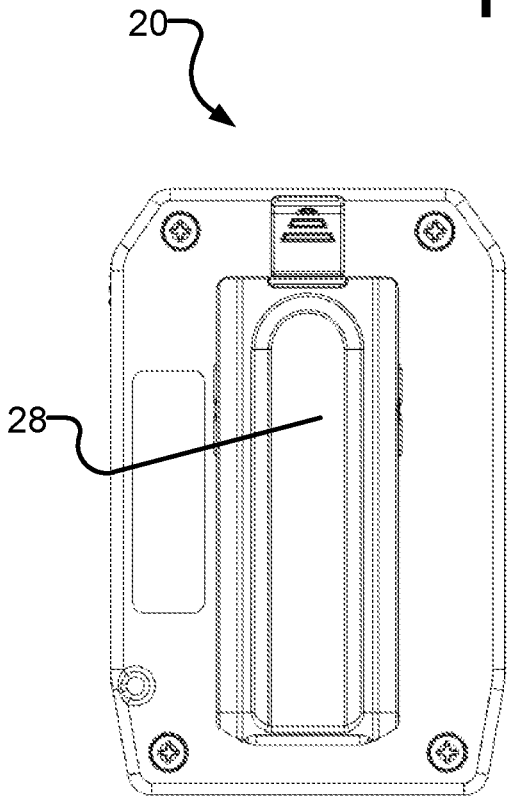
FIG. 1B is a rear view of a dispensing apparatus according to an example embodiment of this invention.
Figure 1C:
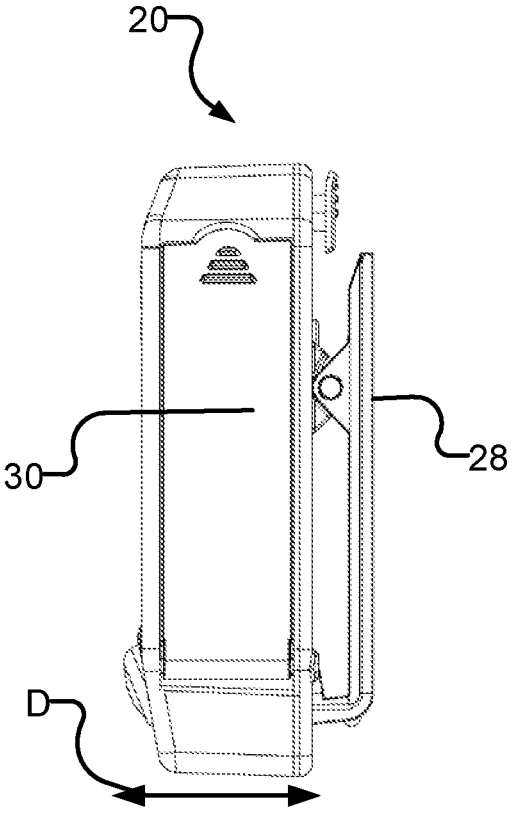
FIG. 1C is a side view of a dispensing apparatus according to an example embodiment of this invention.

FIGS. 1B and 1C are respectively a rear view and a side view of dispensing apparatus 20 according to an example embodiment. Door 30 provides access to a chamber 31 (see FIG. 4B) which can receive cartridge 32 containing hand sanitizer or another fluid to be dispensed. Door 30 may form a part of housing 22. In the illustrated embodiment, door 30 is located on a side of dispensing apparatus. This is a convenient location when refilling dispensing apparatus 20 while dispensing apparatus 20 is attached to a wearer's belt, harness or clothing.

Cartridges 32 may have a thin flat construction so that they can contain a sufficient volume of fluid while allowing dispensing apparatus 20 to be thin.

Housing 22 of dispensing apparatus 20 contains attachment interface 28. Attachment interface 28 is configured such that dispensing apparatus 20 can be worn by an individual. Attachment interface 28 is configured to attach dispensing apparatus 20 to an individual's clothing.

Attachment interface 28 may be configured such that the entire attachment interface attaches to an individual's clothing, a preferred construction of which is shown in FIGS. 1B and 1C. Attachment interface 28 is depicted as a clip in FIGS. 1B and 1C. The clip allows a user of dispensing apparatus 20 to affix dispensing apparatus 20 to a piece of clothing. For example, attachment interface 28 can be attached to a belt, a harness, or a piece of clothing worn by a person. In some embodiments, attachment interface 28 is clipped to the belt of a law enforcement officer for convenient access to the fluid dispensed by dispensing apparatus 20. In another embodiment, attachment interface 28 is clipped to a healthcare worker's scrubs. In some embodiments, attachment interface 28 comprises a MOLLE (modular lightweight load carrying equipment) clip. A MOLLE clip is configured for attachment to strips of fabric stitched to a backpack, vest, uniform or the like. Threading the MOLLE clip through the strips of fabric secures dispensing apparatus 20.

In some embodiments, attachment comprises two separable parts. One of the parts may be attached (removably or non-removably) to an individual's clothing; the other part is attached to housing 22. The two parts have a coupling that enables the two parts to be detachably affixed to one another. In some embodiments, attachment interface 28 comprises a hook and loop fastener such as Velcro™. One component of the hook and loop fastener is affixed to housing 22, and the other component of the hook and loop fastener is affixed to a desired object such as a piece of clothing. In some embodiments, one component of the hook and loop fastener is affixed to the dashboard of a motor vehicle, and the other component of the hook and loop fastener mechanism is affixed to housing 22. In other embodiments, one component of the hook and loop fastener mechanism is affixed to a piece of furniture, and the other component of the hook and loop fastener mechanism is affixed to housing 22. In some embodiments, attachment interface 28 comprises a magnet affixed to housing 22. The magnet may then be used to hold dispensing apparatus 20 to any ferrous metal material. In some embodiments, attachment interface 28 comprises a pair of magnets, with one of the magnets affixed to an individual's clothing, and the other magnet affixed to housing 22.

Figure 2A:
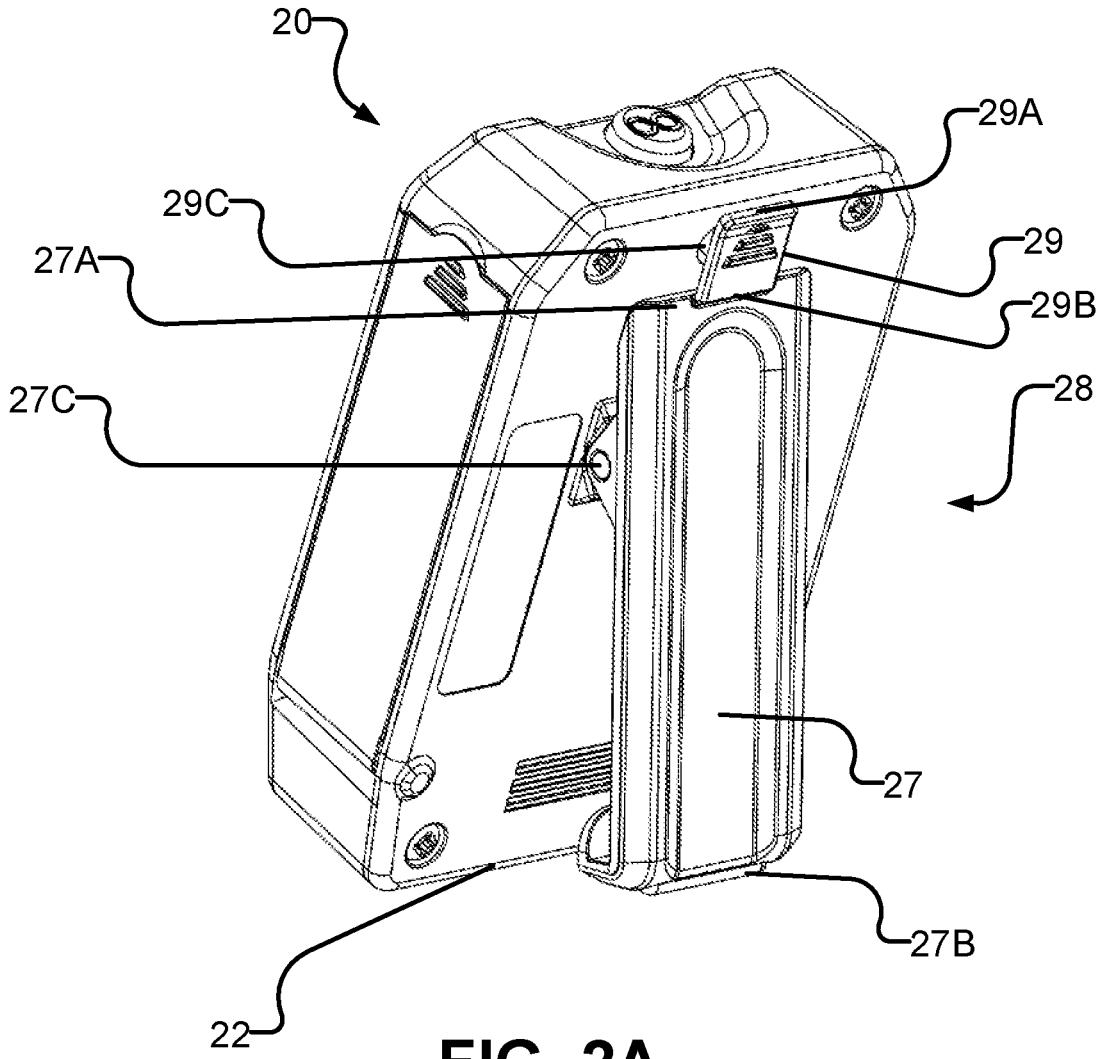
FIG. 2A is a rear perspective view of a dispensing apparatus according to an example embodiment of this invention.

FIG. 2A is a rear view of a dispensing apparatus 20 according to an example embodiment. Attachment interface 28 comprises a clip 27 that has a first end 27A and a second end 27B. Clip 27 is hinged about hinge 27C. Hinge 27C is sprung such that second end 27B of clip 27 is biased towards being in contact with housing 22. Detent 29 is affixed to housing 22 of dispensing apparatus 20. Detent 29 is arranged such that when second end 27B of clip 27 is lifted away from housing 22, first end 27A of clip 27 is held in place by detent 29. By holding in place first end 27A of clip 27, detent 29 resists the spring force imposed by hinge 27C that would otherwise urge second end 27B of clip 27 back into contact with housing 22.

When detent 29 is engaged with first end 27A of clip 27, attachment interface 28 is in an 'open' position. Maintaining attachment interface 28 in an 'open' position is advantageous if one wishes to affix attachment interface 28 to an item of clothing, as it reduces the dexterity needed to affix attachment interface 28 to an item of clothing while also depressing first end 27A of clip 27 against the force of hinge 27C.

In some embodiments, clip 27 is configured to allow a user to stand dispensing apparatus 20 on a surface. When clip 27 is in an 'open' position, second end 27B of clip 27 and the bottom of housing 22 form a base on which dispensing apparatus 20 can be rested.

In some embodiments, to revert attachment interface 28 from an 'open' position to a 'closed' position, a user depresses first end 29A of detent 29. Depressing first end 29A of detent 29 bends detent 29 about detent stem 29C. Bending detent 29 about detent stem 29C releases first end 27A of clip 27 from second end 29B of detent 29. Once first end 27A of clip 27 is released, hinge 27C causes attachment interface 28 to close by biasing second end 27B of clip 27 back into contact with housing 22.

Figure 2B:
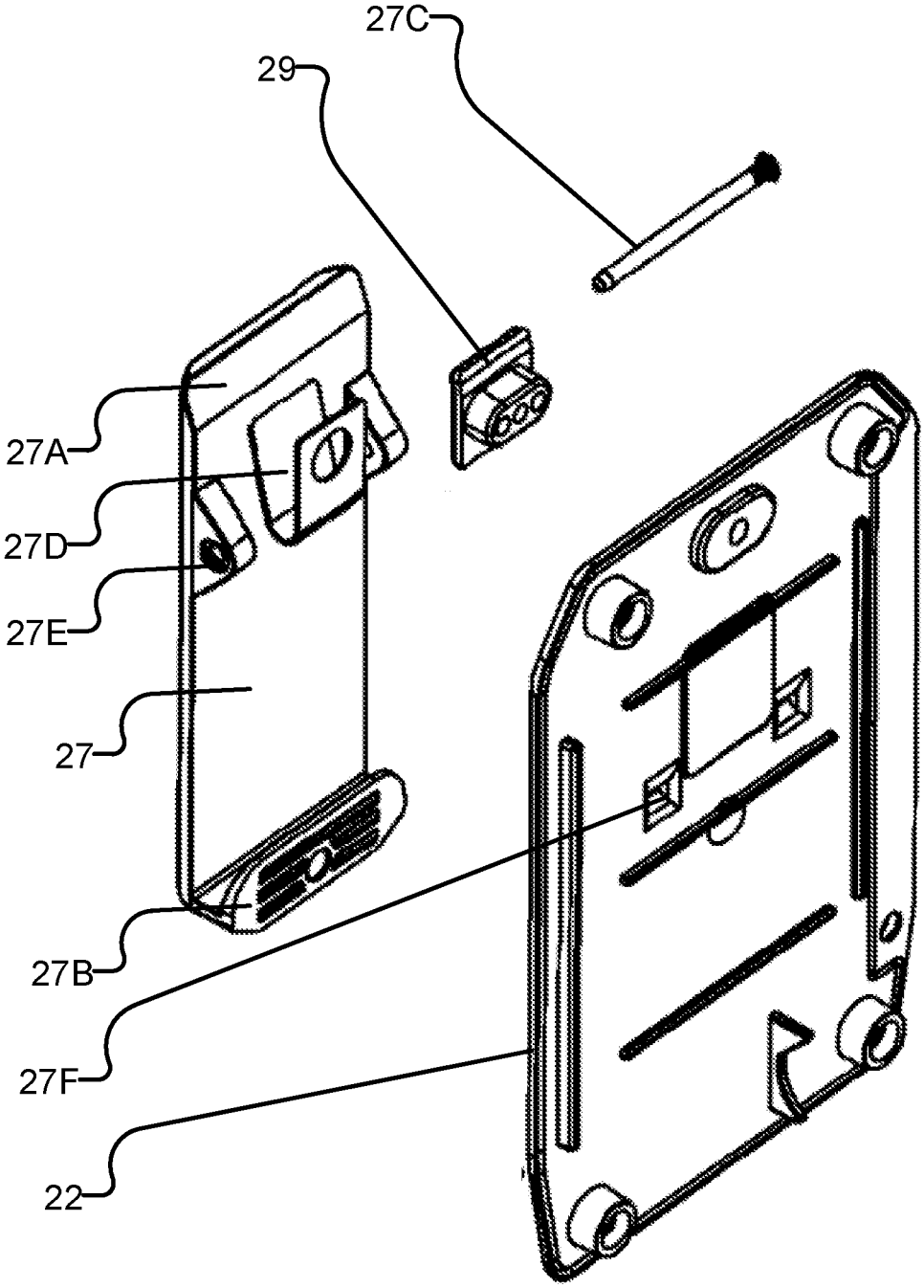
FIG. 2B is an exploded view of an attachment interface on a dispensing apparatus according to an example embodiment of this invention.

FIG. 2B is a rear exploded perspective view of attachment interface 28 according to an example embodiment. Attachment interface 28 contains bias mechanism 27D. In some embodiments, bias mechanism 27D is operable to bias second end 27B of clip 27 into contact with housing 22. In some embodiments, bias mechanism 27D is operable to bias second end 27B of clip 27 into close proximity with housing 22. In some embodiments, bias mechanism 28D comprises a bent sheet of an elastically deformable metal. Hinge 27C is depicted as a rod that passes through mating holes 27E on clip 27, and mating holes 27F on housing 22.

Attachment interface 28 as described herein enables a user to affix dispensing apparatus 20 to an item of clothing. Given that dispensing apparatus 20 can be worn by an individual, the colour of housing 22 on dispensing apparatus 20 may be customized. In some embodiments, the colour, design and/or texture of housing 22 may be customized or customizable to match a uniform design. For example, housing 22 could have a camouflage design if being used by a member of a military. In some embodiments, housing 22 is customized to display a logo. For example, housing 22 may bear a logo or a coat of arms of an organization.

Figure 3B:
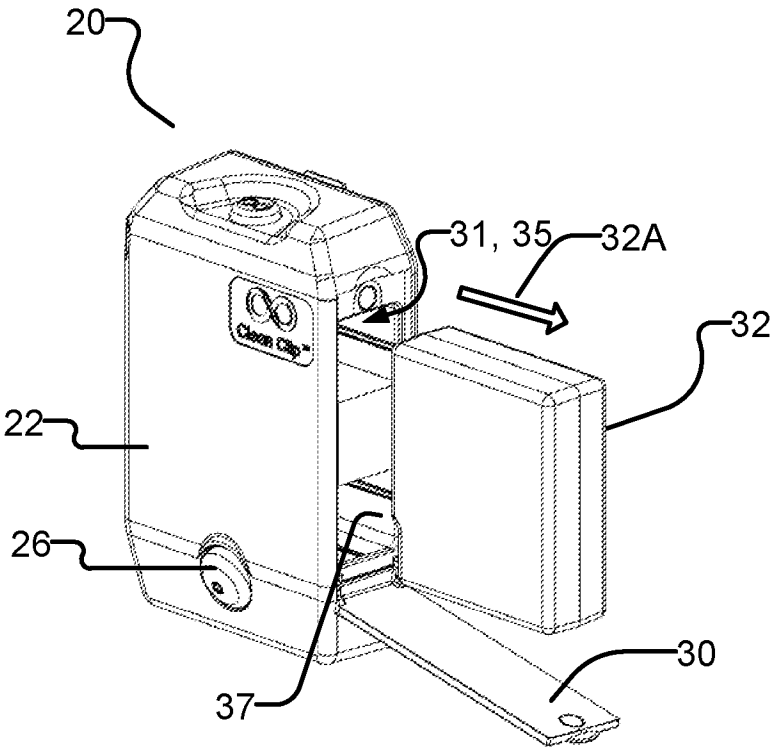
FIG. 3B is a perspective view of a dispensing apparatus without a cartridge according to an example embodiment of this invention.
Figure 3A:
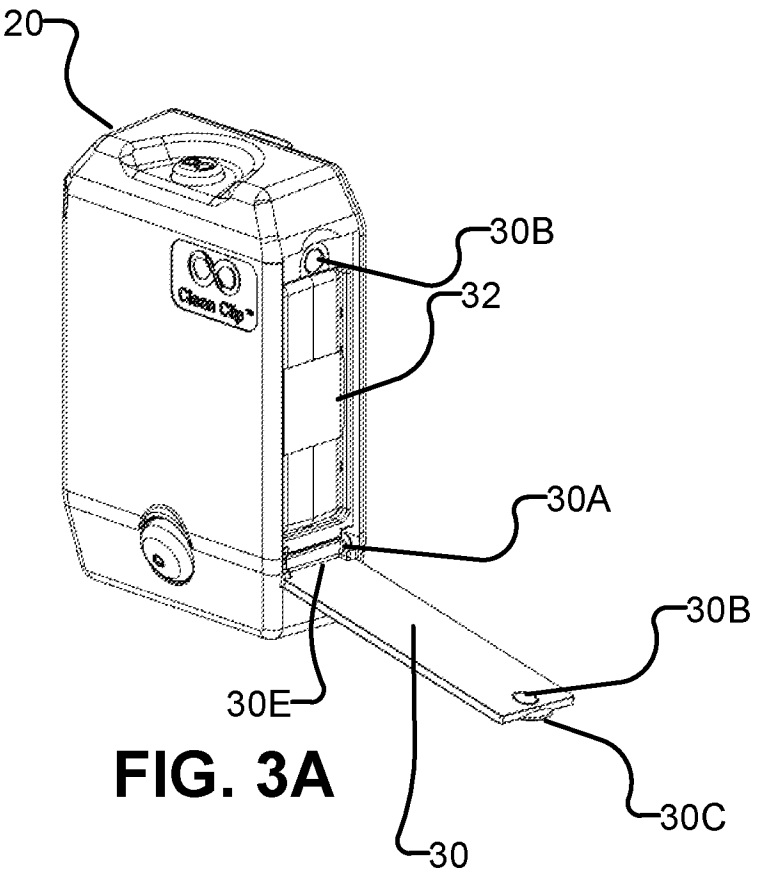
FIG. 3A is a perspective view of a dispensing apparatus with a cartridge door open according to an example embodiment of this invention.

FIG. 3A is a perspective view of dispensing apparatus 20 with door 30 in an open position according to an example embodiment. Door 30 is configured to allow access to a cavity 35 for receiving cartridge 32.

FIG. 3A shows door 30 hinged about hinge 30A. Door 30 hinges outwards from hinge 30A about bottom edge 30E of door 30. Door 30 is shown in an open position in FIG. 3A.

Door 30 is shown in a closed position in FIG. 1C. Door 30 is configured to facilitate rapid and convenient access to cavity 35.

Dispensing apparatus 20 may include a latch operable to hold door 30 in a closed position.

In some embodiments, the latch comprises a pair of magnets 30B which hold door 30 closed when door 30 is in a closed position (shown in FIG. 1C). A user can pull on tab 30C to separate the pair of magnets 30B and move door 30 to an open position, as depicted in FIG. 3A. In some embodiments, door 30 has one magnet 30B and a piece of ferrous material with which the one magnet 30B engages. Other types of latches may be provided to allow door 30 to be opened, for example to change out cartridge 32.

Other embodiments may use different approaches to allow access to the interior of dispensing apparatus 20. For example, in some embodiments, door 30 is configured to have a set of pins on one side, with a clip on the opposite side, with receptacles for the pins and clip on housing 22. In some embodiments, door 30 is omitted to enable easy access to remove and replace cartridge 32.

Cartridge 32 is held inside cavity 35 in housing 22. Cartridge 32 holds fluid to be dispensed. Cartridge 32 is replaceable. Upon all of the fluid being dispensed from cartridge 32, a user can open door 30 to remove cartridge 32, and place a new cartridge 32 in cavity 35 of dispensing apparatus 20. Cartridge 32 preferably has a rigid or semi-rigid construction. Cartridge 32 may comprise a rigid or semi-rigid material.

FIG. 3B shows cartridge 32 being removed from dispensing apparatus 20 according to an example embodiment. By pulling cartridge 32 out of dispensing apparatus 20 in the direction represented by arrow 32A, cartridge 32 can be removed. Cartridge 32 is guided in and out of dispensing apparatus 20 by chassis 37 inside of dispensing apparatus 20.

Figure 3C:
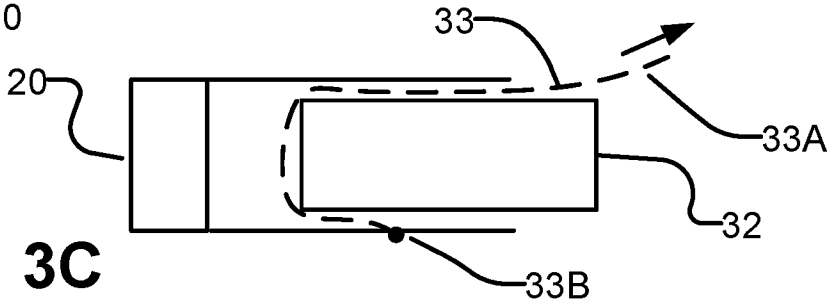
FIG. 3C is a schematic cross section view through a dispensing apparatus illustrating application of a tape or ribbon for removing a cartridge from a fully-inserted position.

In some embodiments, a pull tab is provided to assist with the removal of cartridge 32 from dispensing apparatus 20. For example, as shown in FIG. 3C, a pull tab 33 may be affixed at an anchor point 33A on one side of cavity 35 and may wrap around the end of cartridge 32. A user may grasp and pull on a free end of pull tab 33 to assist with removing cartridge 32 from chamber 31 of dispensing apparatus 20.

In some embodiments, pull tab 33 contains graphical and/or textual instructions for use of dispensing apparatus 20. In some embodiments, the pull tab is affixed to chassis 37, wrapping around cartridge 32 when cartridge 32 is inserted into dispensing apparatus 20. Pulling on the pull tab in this embodiment partially removes cartridge 32 from dispensing apparatus 20, enabling easier removal of cartridge 32 from dispensing apparatus 20.

Cartridge 32 contains a fluid. In particular, cartridge 32 is intended to contain a fluid that can be used as hand sanitizer. The hand sanitizer may, for example, comprise an alcohol-based hand sanitizer or any other hand sanitizer.

Cartridge 32 is depicted as having a substantially rectangular flattened shape. In some embodiments, cartridge 32 has a different shape, for example (but not limited to) a cylinder, a cube, or an ellipsoid.

Figure 4B:
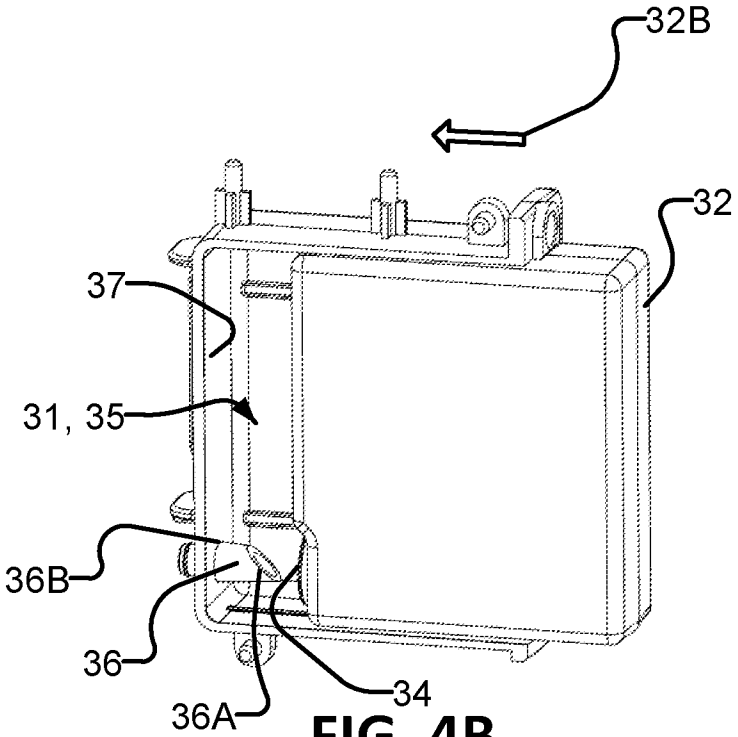
FIG. 4B is a perspective view of a cartridge being installed in a dispensing apparatus according to an example embodiment of this invention.
Figure 4A:
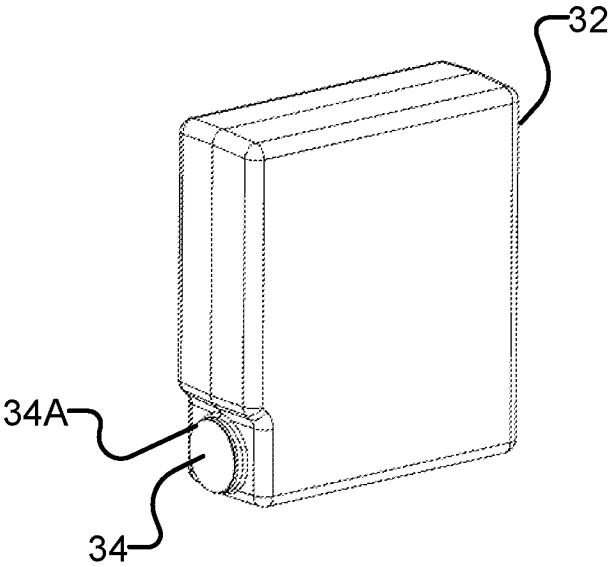
FIG. 4A is a perspective view of a cartridge according to an example embodiment of this invention.

FIG. 4A is a perspective view of cartridge 32 according to an example embodiment. FIG. 4B is an internal view of dispensing apparatus 20 showing cartridge 32 being replaced according to an example embodiment. Cartridge 32 comprises seal 34. Seal 34 allows dispensing apparatus 20 to dispense the fluid from within cartridge 32. Cartridge 32 is inserted into dispensing apparatus 20 by moving cartridge 32 in the direction represented by arrow 32B. Chassis 37, located within housing 22, guides cartridge 32 such that spur 36 pierces seal 34 when cartridge 32 is inserted into dispensing apparatus 20 in the direction represented by arrow 32B. Upon inserting cartridge 32 into dispensing apparatus 20, seal 34 is pierced by spur 36.

Spur 36 is tubular such that it forms a through passage through which liquid can flow. Tip 36A of spur 36 is configured to provide a pointed edge that can pierce seal 34. An end portion of spur 36 near tip 36A may be tapered in diameter. The taper of spur 36 may interface with a corresponding surface inside seal 34 to improve the fluid-tight seal between spur 36 and cartridge 32.

Seal 34 is made from a material that keeps fluid contained within cartridge 32 while cartridge 32 is not in use and can be pierced by spur 36 when cartridge 32 is placed in use. By way of non limiting examples, seal 34 may comprise a thin sheet of aluminum, an aluminum plastic laminate, or a sheet of plastic-coated paper.

Gasket 34A may be provided on the perimeter of seal 34. Gasket 34A, when present, may help to improve sealing between cartridge 32 and spur 36. When cartridge 32 is moved in direction 32B and spur 36 pierces seal 34, gasket 34A encircles spur perimeter 36B, thereby creating a fluid-tight seal. Gasket 34A is preferably made of a deformable material such as rubber to further improve the fluid-tight seal between cartridge 32 and spur 36.

In some embodiments, cartridge 32 includes a vent which allows air to enter cartridge 32 as fluid is removed from cartridge 32. In some embodiments, small amounts of air are allowed to enter cartridge 32 through the interface between seal 34 and spur 36 or through seal 34 as fluid is withdrawn from cartridge 32. In some embodiments, portions of one or more walls of cartridge 32 are thin such that upon pressure being reduced within cartridge 32, a part of the wall of cartridge 32 is deformed. In some embodiments, dispensing apparatus 20 includes a stylet or needle or the like that punctures cartridge 32 to provide a vent when cartridge 32 is inserted into dispensing apparatus 20. For example, the stylet or the like may be provided on the inner wall of chamber 31 or on door 30 so that an air hole is pricked in cartridge 32 upon cartridge 32 being inserted into dispensing apparatus 20 or upon door 30 being closed.

When cartridge 32 is moved in direction 32B and spur 36 pierces seal 34, spur 36 will be fluidly connected to the liquid inside of cartridge 32. The liquid inside of cartridge 32 can then flow from cartridge 32 through the tubular through passage formed by spur 36.

There are at least two advantages associated with cartridge 32 being replaceable. One advantage is that a replaceable cartridge enables rapid replenishment of the fluid carried by dispensing apparatus 20. A user of dispensing apparatus 20 can carry spare cartridges 32 with them to enable continued and extended use of dispensing apparatus 20. The cartridges may be sturdy, rigid, or semi-rigid cartridges that can be safely stored in a pocket, glove compartment or the like.

In some embodiments, cartridge 32 is refillable. In some embodiments, cartridge 32 is recyclable. In some embodiments, cartridge 32 is disposable. In some embodiments, cartridge 32 is both recyclable and disposable. A second advantage associated with cartridge 32 being replaceable is that it enables a user to change the fluid being dispensed from dispensing apparatus 20 (for example, changing from hand sanitizer to ointment), as the apparatus will dispense whatever fluid is contained within cartridge 32.

In some embodiments, dispensing apparatus 20 includes an indicator which indicates when a cartridge 32 needs replacing and/or the amount of fluid remaining in cartridge 32. The indicator may, for example, be visual and/or audible. Some embodiments provide an indicator light on housing 22 that illuminates upon the amount of fluid remaining in the cartridge reaching a prescribed level. Some embodiments include an electroacoustic transducer that emits a noise when the amount of fluid remaining in the cartridge 32 reaches a prescribed level. The electroacoustic transducer may, for example, comprise a speaker, a buzzer or the like. In some embodiments, the visual indicator comprises a display (e.g. an OLED display or an LCD display) located on housing 22 that provides a readout indicative of an amount of fluid remaining in cartridge 32.

Given the small form-factor of dispensing apparatus 20, it is not possible for dispensing apparatus 20 to contain large amounts of fluid for dispensing without becoming unwieldy when worn by an individual due to the weight of dispensing apparatus 20. For this reason, cartridge 32 may have a capacity of, for example, 40 mL of fluid. Because of the relatively small volume of fluid held by cartridge 32, cartridge 32 is replaceable. This enables continued and extended use of small and light weight dispensing apparatus 20. In some embodiments, dispensing apparatus 20 weighs less than 6 ounces or 7 ounces. For example, dispensing apparatus 20 may weigh in the range of 4 to 6 ounces.

Figure 5:
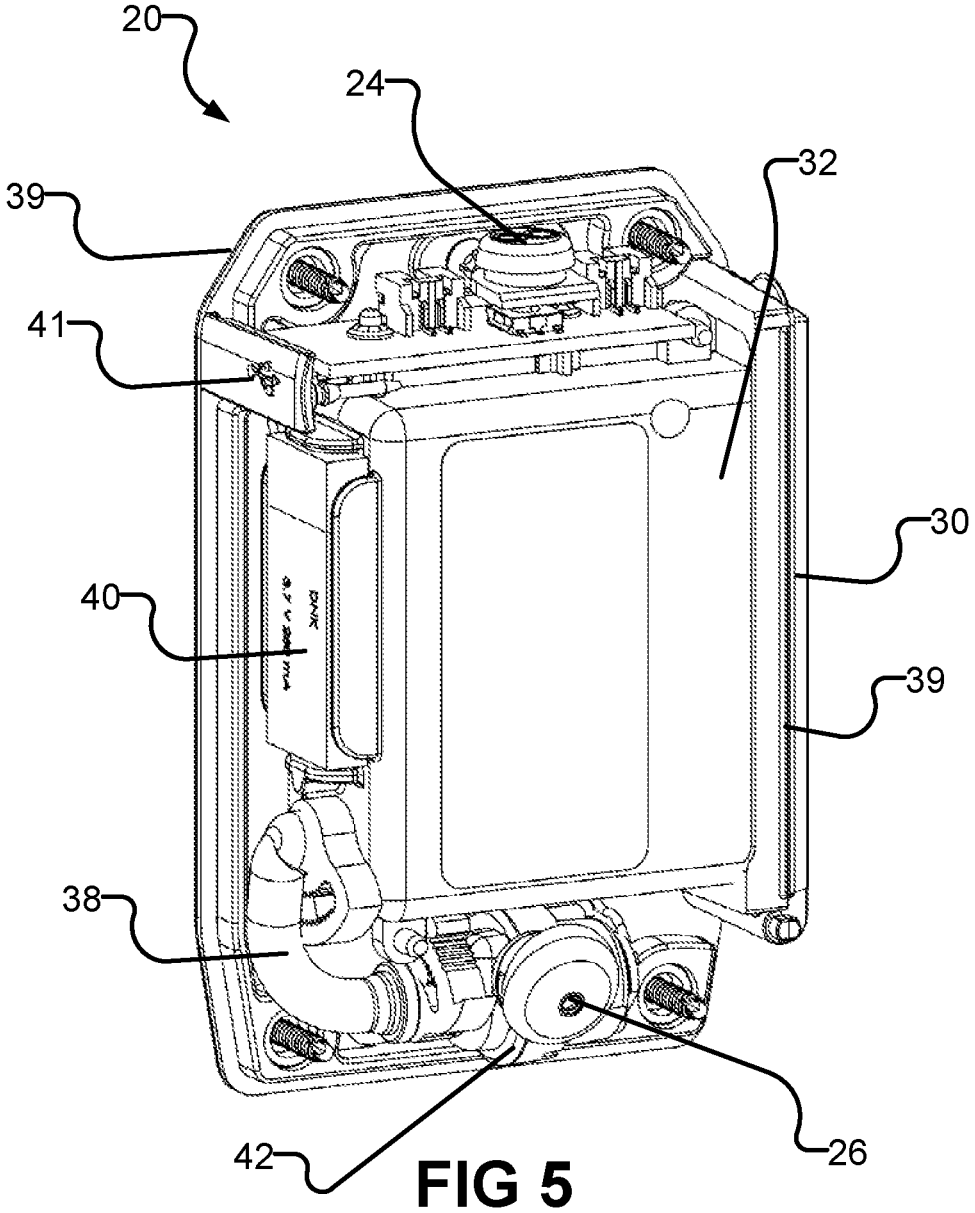
FIG. 5 is a perspective view of a dispensing apparatus without a housing according to an example embodiment of this invention.

FIG. 5 is a perspective view of dispensing apparatus 20 with housing 22 removed according to an example embodiment. FIG. 5 shows conduit 38, power source 40, and a metering mechanism which, in the illustrated embodiment comprises actuator 42. Conduit 38 is fluidly connected to spur 36 (shown in FIG. 4B). Spur 36 is fluidly connected to the liquid within cartridge 32. Conduit 38 is fluidly connected to actuator 42. Actuator 42 is fluidly connected to outlet 26.

The metering mechanism is actuated to dispense a quantity of fluid from outlet 26 in response to engagement interface 24 being operated (e.g. by a user pressing or touching engagement interface 24 with their hand). When the metering mechanism is actuated, actuator 42 dispenses a prescribed volume of fluid from cartridge 32 to outlet 26.

In the example embodiment of FIG. 5, actuator 42 is a pump. The pump in the example embodiment of FIG. 5 is electrically coupled to power source 40. Power source 40 is depicted as a battery. In FIG. 5, the battery is depicted as a rechargeable battery, rechargeable through recharging interface 41. In some embodiments, recharging interface 41 is powered by a USB connector. Other embodiments may utilize different power sources. In some embodiments, power source 40 comprises one or more suitable batteries (e.g. AA, AAA, C, or D types). In some embodiments, the battery is accessible for replacement by way of another door, similar in function to door 30.

Some embodiments include an indicator that indicates the level of power remaining in power source 40. The indicator may, for example, be visual and/or audible. For example, in some embodiments, the power level indicator comprises an indicator light. The indicator light may, for example, be an LED (light emitting diode). In some embodiments, the power level indicator is located on or near recharging interface 41. In some embodiments, the power level indicator is located on housing 22.

Figure 5A:
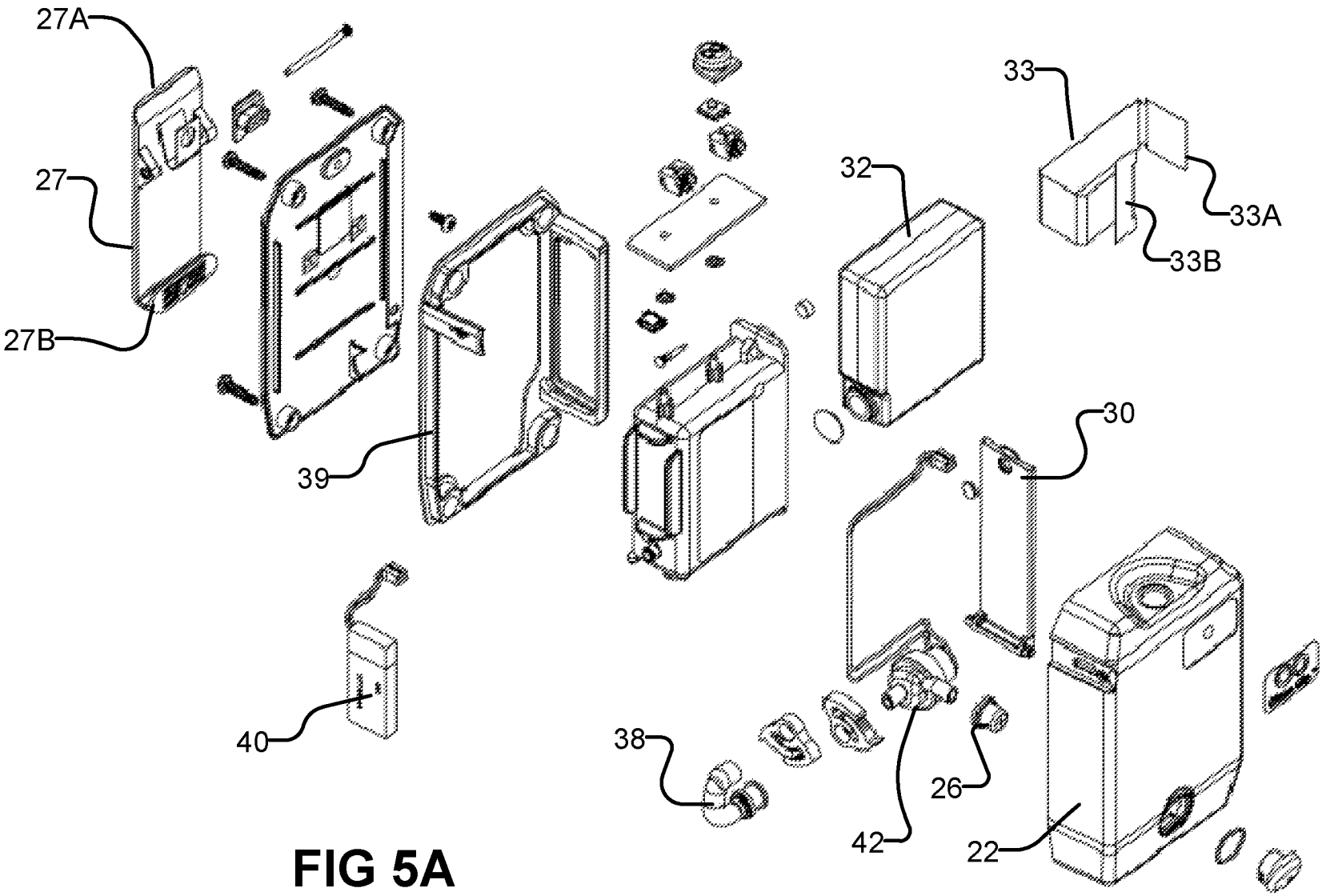
FIG. 5A is an exploded view of an example dispensing apparatus.

FIGS. 5 and 5A show grommet 39. Grommet 39 helps to provide a moisture and dust-tight seal within housing 22. Grommet 39 is located at the interfaces between the various components on housing 22, including (but not limited to) in between door 30 and housing 22, engagement interface 24 and housing 22, outlet 26 and housing 22, and around the edges of housing 22. In some embodiments, grommet 39 provides a seal between chassis 37 and housing 22 and also provides a seal around the edges of cavity 35.

Figure 6:
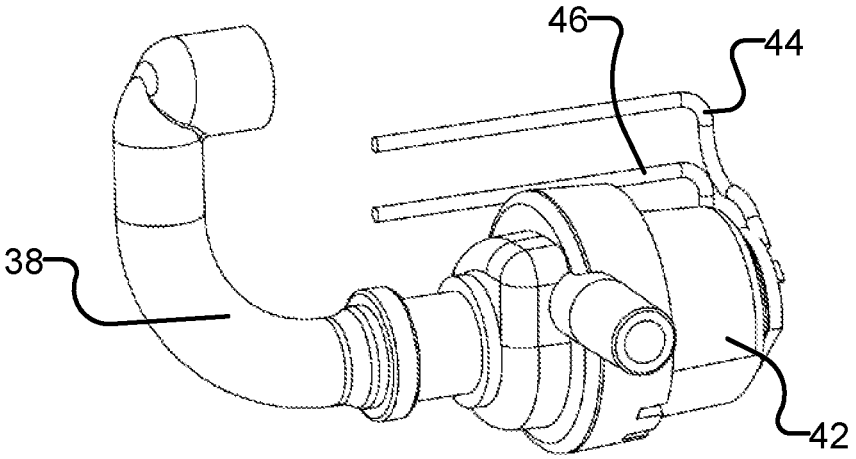
FIG. 6 is a perspective view of a conduit and actuator according to an example embodiment of this invention.

FIG. 6 is a perspective view of conduit 38 and actuator 42 according to an example embodiment. Conduit 38 is coupled to spur 36 (see FIG. 4B) which is fluidly connected to the fluid in cartridge 32. Because actuator 42 in the example embodiment shown in FIG. 6 is an electrically powered pump, wires 44 and 46 electrically couple actuator 42 to a circuit which delivers power from power source 40 (see FIG. 5) to operate actuator 42 when engagement interface 24 has been actuated.

In some embodiments, actuator 42 is customizable to dispense a particular volume of fluid. For example, actuator 42 may be configured to dispense fluid in 1 mL or 2 mL increments upon operation of engagement interface 24. In some embodiments, actuator 42 is configured to dispense fluid in increments ranging between 0.5 mL to 20 mL.

Upon engaging with engagement interface 24, an electronic circuit controls delivery of power to actuator 42 through wires 44 and 46. The electronic circuit may be configured to supply power to actuator 42 for a prescribed period and/or a prescribed number of pulses, thereby dispensing a desired quantity of the fluid at outlet 26. The length of the prescribed period and/or the number of pulses may be customizable to adjust how much fluid actuator 42 dispenses each time it is triggered by operation of engagement interface 24. The longer the prescribed period and/or the more pulses, the more fluid will be dispensed. Upon the expiration of the prescribed period, power to the actuator is stopped, thereby stopping the fluid from being dispensed.

In some embodiments, actuator 42 is a pump of a type that delivers a set amount of fluid per stroke. In such embodiments actuator 42 may be operated for one or more strokes (depending on the desired amount of fluid to be released) each time engagement interface 24 is operated. In some embodiments, actuator 42 comprises a pump having an adjustable stroke volume and the amount of fluid to be released is adjustable by adjusting the stroke volume of the pump.

As described herein, dispensing apparatus 20 may be used by front line workers to protect themselves and to protect persons with whom they may come into contact. The apparatus may be implemented in situations that require convenient and immediate access to hand sanitizer. By facilitating rapid access to hand sanitizer, the apparatus can improve the safety of the front line workers themselves, and the individuals they are serving. For example, a police officer may use dispensing apparatus 20 to maintain access to hand sanitizer throughout the day. The police officer could attach dispensing apparatus 20 to their belt. The police officer would likely be wearing a belt containing bulky equipment, and as such, they would first lift second end 27B of clip 27 such that first end 27A of clip 27 is held in place by detent 29. The police officer could then place clip 27 over their belt, and press first end 29A of detent 29 to release first end 27A of clip 27. At this point, dispensing apparatus 20 would be affixed to the police officer's belt by clip 27. Then, as required, the police officer can engage with engagement interface 24 to release hand sanitizer from dispensing apparatus 20. Since engagement interface 24 is placed on a portion of housing 22 that is recessed, accidental engagements with engagement interface 24 are avoided. If dispensing apparatus 20 runs out of hand sanitizer, then the police officer can quickly open door 30 on the side of housing 22, remove cartridge 32, and insert a replacement cartridge 32.

At the end of the day, the police officer may remove dispensing apparatus 20 from their belt. If they find themselves completing paperwork at a desk, they can stand dispensing apparatus 20 on their desk by lifting second end 27B of clip 27 such that first end 27A of clip 27 is held in place by detent 29. Second end 27B of clip 27 and the bottom of housing 22 then form a base on which dispensing apparatus 20 can stand for easy access.

INTERPRETATION OF TERMS

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

While processes or blocks are presented in a given order, alternative examples may perform routines having steps, or employ systems having blocks, in a different order, and some processes or blocks may be deleted, moved, added, subdivided, combined, and/or modified to provide alternatives or subcombinations. Each of these processes or blocks may be implemented in a variety of different ways. Also, while processes or blocks are at times shown as being performed in series, these processes or blocks may instead be performed in parallel, or may be performed at different times.

In addition, while elements are at times shown as being performed sequentially, they may instead be performed simultaneously or in different sequences. It is therefore intended that the following claims are interpreted to include all such variations as are within their intended scope.

Where a component (e.g. a housing, an attachment interface, an actuator etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

Various features are described herein as being present in "some embodiments". Such features are not mandatory and may not be present in all embodiments. Embodiments of the invention may include zero, any one or any combination of two or more of such features. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible).

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A wearable personal dispensing apparatus comprising:

a housing;

an attachment interface affixed to the housing and operable to affix the dispensing apparatus to an item of clothing;

an outlet on the housing;

a replaceable cartridge containing a fluid, the replaceable cartridge including a breakable seal that punctures upon being inserted into the dispensing apparatus and wherein the cartridge is a semi-rigid or rigid said cartridge which includes a vent which allows air to enter the cartridge as fluid is removed therefrom;

an electrically-powered metering mechanism fluidly connected to the outlet; and an engagement interface on the housing, the engagement interface operable to control the metering mechanism to dispense a volume of the fluid from the outlet.

2. The wearable personal dispensing apparatus of claim 1 wherein the breakable seal is puncturable by a spur that is fluidly connected to the outlet.

3. The wearable personal dispensing apparatus of claim 2, wherein small amounts of air are allowed to enter the cartridge through the interface between the seal and the spur or through the seal, as fluid is withdrawn from the cartridge.

4. The wearable personal dispensing apparatus of claim 1, wherein portions of one or more walls of the cartridge are thin such that upon pressure being reduced within the cartridge, a part of the wall of the cartridge is deformed.

5. The wearable personal dispensing apparatus of claim 1, including a stylet or needle that punctures the cartridge to provide said vent when the cartridge is inserted into the apparatus.

6. The wearable personal dispensing apparatus of claim 5, wherein the housing includes a chamber within which the cartridge is received and wherein the stylet or needle is positioned on an inner wall of the chamber such that an air hole is formed in the cartridge upon the cartridge being inserted into the apparatus.

7. The wearable personal dispensing apparatus of claim 5, including a door formed in the housing and via which the cartridge is received therein, and wherein the stylet or needle is positioned on the door such that an air hole is formed in the cartridge upon the door being closed thereafter.

8. The wearable personal dispensing apparatus of claim 1, wherein the engagement interface is a button, wherein the housing includes a recessed portion with a side wall which encloses the button, and wherein the button is inwardly spaced from said side wall.

9. The wearable personal dispensing apparatus of claim 1, wherein the engagement interface is a button, wherein the housing includes a recessed portion with a side wall having a first radius of curvature, wherein the button is positioned within the recessed portion of the housing and wherein the button has a second radius of curvature which is less than said first radius of curvature.

10. The wearable personal dispensing apparatus of claim 1, wherein the housing includes an upper portion to which the engagement interface mounts and whose front, rear and sides each upwardly taper.

11. The wearable personal dispensing apparatus of claim 1, wherein the housing includes an upper portion which is an isosceles trapezoid in shape in front, rear and side profile.

12. The wearable personal dispensing apparatus of claim 1, wherein the housing has a front and a bottom, and wherein the outlet is angled at a non-perpendicular angle relative to the front and the bottom of the housing.

13. The wearable personal dispensing apparatus of claim 1, wherein the housing has a front and a bottom, wherein the outlet is angled relative to the front and the bottom of the housing, and wherein the outlet is spaced upwards from the bottom of the housing.

14. The wearable personal dispensing apparatus of claim 1 wherein the fluid is hand sanitizer.

15. The wearable personal dispensing apparatus of claim 1 wherein the item of clothing is a belt and wherein the attachment interface is configured to couple the housing to the belt.

16. The wearable personal dispensing apparatus of claim 1 wherein the attachment interface on the housing is a clip.

17. The wearable personal dispensing apparatus of claim 16 including a bias mechanism operable to bias the clip to a generally closed position.

18. The wearable personal dispensing apparatus of claim 17 comprising a detent that is operable to hold the clip in a generally open position against the force applied by the bias mechanism.

19. The wearable personal dispensing apparatus of claim 18 wherein the dispensing apparatus can be placed on a surface while the clip is held in a generally open position by the detent.

20. The wearable personal dispensing apparatus of claim 1 wherein the attachment interface is a hook and loop fastener.

21. The wearable personal dispensing apparatus of claim 1 wherein the attachment interface comprises a pair of magnets.

22. The wearable personal dispensing apparatus of claim 1 wherein the attachment interface is a MOLLE connector.

23. The wearable personal dispensing apparatus of claim 1 wherein the engagement interface is centered on the housing.

24. The wearable personal dispensing apparatus of claim 1, wherein the engagement interface is a button operable to control the metering mechanism to dispense the fluid.

25. The wearable personal dispensing apparatus of claim 1 wherein the metering mechanism dispenses a prescribed volume of fluid.

26. The wearable personal dispensing apparatus of claim 1 wherein the metering mechanism is a pump that is fluidly connected to the replaceable cartridge and the outlet.

27. The wearable personal dispensing apparatus of claim 1 wherein the metering mechanism is located below the replaceable cartridge.

28. The wearable personal dispensing apparatus of claim 26 wherein the pump is electrically powered.

29. The wearable personal dispensing apparatus of claim 28 wherein the pump is electrically powered by a battery.

30. The wearable personal dispensing apparatus of claim 29 wherein the battery is rechargeable.

31. The wearable personal dispensing apparatus of claim 30 wherein the battery is rechargeable via a USB recharging interface.

32. The wearable personal dispensing apparatus of claim 29 wherein the housing includes an indicator to indicate the level of charge remaining in the battery.

33. The wearable personal dispensing apparatus of claim 29 wherein the battery is disposable.

34. The wearable personal dispensing apparatus of claim 29, wherein the pump is electrically powered by one or more AA batteries, one or more AAA batteries, one or more D batteries, or one or more C batteries.

35. The wearable personal dispensing apparatus of claim 1 wherein the replaceable cartridge is disposable.

36. The wearable personal dispensing apparatus of claim 1 wherein the replaceable cartridge is recyclable.

37. The wearable personal dispensing apparatus of claim 1 wherein the replaceable cartridge is replaceable with another replaceable cartridge containing a different fluid.

38. The wearable personal dispensing apparatus of claim 1 including a door formed in the housing and via which the replaceable cartridge is accessible.

39. The wearable personal dispensing apparatus of claim 1 including a door formed on a side of the housing and via which the replaceable cartridge is received.

40. The wearable personal dispensing apparatus of claim 38 wherein the door includes a latch comprised of a pair of magnets.

41. The wearable personal dispensing apparatus of claim 1 wherein the replaceable cartridge spans almost all the entire way across the housing.

42. The wearable personal dispensing apparatus of claim 1 wherein the replaceable cartridge is inserted sideways into the housing.

43. The wearable personal dispensing apparatus of claim 1 wherein the replaceable cartridge includes a pull tab.

44. The wearable personal dispensing apparatus of claim 43 wherein the pull tab contains an instruction manual.

45. The wearable personal dispensing apparatus of claim 1 wherein the replaceable cartridge holds 40 mL of fluid or less.

46. The wearable personal dispensing apparatus of claim 1 including an indicator light which illuminates upon the remaining amount of the fluid in the replaceable cartridge reaching a prescribed level.

47. The wearable personal dispensing apparatus of claim 1, including a speaker via which a sound is emitted upon the amount of the fluid in the replaceable cartridge reaching a prescribed level.

48. The wearable personal dispensing apparatus of claim 1 wherein the height of the housing is less than 150 mm.

49. The wearable personal dispensing apparatus of claim 1 wherein the height of the housing is less than 120 mm.

50. The wearable personal dispensing apparatus of claim 1 wherein the height of the housing is less than 100 mm.

51. The wearable personal dispensing apparatus of claim 1 wherein the width of the housing is less than 100 mm.

52. The wearable personal dispensing apparatus of claim 1 wherein the width of the housing is less than 80 mm.

53. The wearable personal dispensing apparatus of claim 1 wherein the width of the housing is less than 70 mm.

54. The wearable personal dispensing apparatus of claim 1 wherein the depth of the housing is less than 40 mm.

55. The wearable personal dispensing apparatus of claim 1 wherein the depth of the housing is less than 30 mm.

56. The wearable personal dispensing apparatus of claim 1 wherein the depth of the housing is less than 25 mm.

57. The wearable personal dispensing apparatus of claim 1 wherein the housing comprises any one of, or combination of, the following: plastic, metal, and leather.

58. The wearable personal dispensing apparatus of claim 38 wherein the housing comprises a grommet at the interface between the housing and the engagement interface, the housing and the attachment interface, the housing and the door, and around the edges of the housing.

59. The wearable personal dispensing apparatus of claim 1 wherein the personal dispensing apparatus has an ingress protection rating of IP45.

60. The wearable personal dispensing apparatus of claim 1 wherein the personal dispensing apparatus has an ingress protection rating of IP67.

61. The wearable personal dispensing apparatus of claim 1 wherein the housing is impact resistant.

62. The wearable personal dispensing apparatus of claim 1 wherein the housing has rounded edges.

63. The wearable personal dispensing apparatus of claim 1 wherein the wearable personal dispensing apparatus weighs between 4 and 6 ounces.

64. The wearable personal dispensing apparatus of claim 1 wherein the outlet is positioned to direct fluid both downwards at least in part and laterally outwards at least in part.

65. The wearable personal dispensing apparatus of claim 1 wherein the housing has a top and a rear, wherein the engagement interface is adjacent to and downwardly spaced from the top of the housing, and wherein the engagement interface is outwardly spaced from the rear of the housing.

66. The wearable personal dispensing apparatus of claim 1 wherein the engagement interface is inwardly positioned relative to a periphery of the housing.

67. The wearable personal dispensing apparatus of claim 1 wherein the housing includes an outwardly extending protrusion adjacent to, at least partially enclosing and being shaped to inhibit inadvertent actuation of the engagement interface.

68. The wearable personal dispensing apparatus of claim 1, including a tape or ribbon configured to enable removable of the cartridge from the housing.

* * * * *